US006494508B1

(12) United States Patent
Dreisbach et al.

(10) Patent No.: US 6,494,508 B1
(45) Date of Patent: Dec. 17, 2002

(54) TAMPER EVIDENT SECURITY SEAL

(75) Inventors: Richard Dreisbach, North Arlington, NJ (US); George Albert Lundberg, Jr., Pompton Plains, NJ (US); Carlos Pinho, North Arlington, NJ (US)

(73) Assignee: E. J. Brooks Company, Livingston, NJ (US)

( * ) Notice: Subject to any disclaimer, the term of this patent is extended or adjusted under 35 U.S.C. 154(b) by 0 days.

(21) Appl. No.: 09/447,692

(22) Filed: Nov. 23, 1999

(51) Int. Cl.[7] ..... B65D 27/30

(52) U.S. Cl. ..... 292/307 R; 292/307 A

(58) Field of Search ..... 292/307 R, 315, 292/317, 318, 320, 321, 326, 307 A, 307 B

(56) References Cited

U.S. PATENT DOCUMENTS

| | | | | |
|---|---|---|---|---|
| 881,407 A | | 3/1908 | Jewett | |
| 959,401 A | * | 5/1910 | Stroh | |
| 1,059,689 A | * | 4/1913 | Webb | |
| 1,520,578 A | * | 12/1924 | Kitchell | 292/318 |
| 1,614,592 A | * | 1/1927 | Behrman | |
| 1,697,954 A | | 1/1929 | Gribbie | |
| 1,930,560 A | | 10/1933 | Keidel | |
| 2,006,051 A | * | 6/1935 | Keidel | 292/328 |
| 2,140,320 A | | 12/1938 | Keidel | |
| 2,204,662 A | * | 6/1940 | Canter | 292/307 |
| 2,321,158 A | | 6/1943 | Rees | |

(List continued on next page.)

FOREIGN PATENT DOCUMENTS

| | | | | |
|---|---|---|---|---|
| FR | 2 632 431 A1 | * | 6/1988 | G09F/3/03 |
| FR | 2 632 431 | | 12/1989 | |
| GB | 2 205 279 A | * | 5/1987 | |

OTHER PUBLICATIONS

Catalog Sheets, Eaton. Stud Receivers, Tinnerman Cap Type Push–On Fasteners, pp. 34 & 35, 1985.

Catalog, Tinnerman brand fasteners, Eaton, pp. 1 thru 32, 1985.

International Search Report, Mar. 22, 2001.

*Primary Examiner*—Gary Estremsky
(74) *Attorney, Agent, or Firm*—Carella Byrne Bain Gilfillan et al; John G. Gilfillan, III; William Squire

(57) ABSTRACT

A filament seal for use with stranded or solid metal or thermoplastic filaments comprises a segmented housing defining a chamber in which a locking insert element is positioned, the insert comprising a thin circular disk of hardened stainless steel with a plurality of radially inwardly extending resilient cantilevered fingers each terminating with a tapered sharp pointed tip in abutting or closely space relationship defining a space substantially smaller than the diameter of the filament. The inserted filament bends the fingers and is softer than the insert, the tips digging into the filament during use. When the filament is withdrawn, the finger tips dig further into the filament severing it. If the filament is rotated in an attempt to thread the filament out of the insert, the insert rotates with the filament due to the digging action of the tips into the filament, precluding filament withdrawal from the insert. A hardened steel washer is adjacent to the insert locking element to preclude bending the tips in the withdrawal direction and breakage of the tips, and precluding defeat of the locking action. The fingers are dimensioned to resist distortion in lateral directions during twisting. Various embodiments are disclosed.

25 Claims, 7 Drawing Sheets

U.S. PATENT DOCUMENTS

| | | | | | |
|---|---|---|---|---|---|
| 2,342,170 | A | | 2/1944 | Tinnerman | |
| 2,342,312 | A | | 2/1944 | Tinnerman | |
| 2,356,856 | A | * | 8/1944 | Komenak | 292/318 |
| 2,394,728 | A | | 2/1946 | Tinnerman | |
| 2,458,409 | A | | 1/1949 | Paige | |
| 2,587,876 | A | * | 3/1952 | Moore | 292/315 |
| 2,623,311 | A | * | 12/1952 | Condon | |
| 2,740,654 | A | | 4/1956 | Orschel | |
| 2,750,220 | A | * | 6/1956 | Keidel | 292/323 |
| 3,275,736 | A | * | 9/1966 | Hotine et al. | 174/84 |
| 3,712,655 | A | * | 1/1973 | Fuehrer | 292/321 |
| 4,185,378 | A | * | 1/1980 | Machida | 29/626 |
| 4,460,203 | A | * | 7/1984 | Moberg et al. | 292/318 |
| 4,500,124 | A | * | 2/1985 | Swift | 292/318 |
| 4,501,049 | A | * | 2/1985 | Adamson | 24/30.5 P |
| 4,859,188 | A | * | 8/1989 | Neumann | 439/45 |
| 4,950,173 | A | * | 8/1990 | Minemura | 439/82 |
| 5,056,837 | A | * | 10/1991 | Fuehrer | 292/307 |
| 5,064,231 | A | * | 11/1991 | Mangone | 292/319 |
| 5,524,945 | A | * | 6/1996 | Georgopoulos et al. | 292/307 A |
| 5,702,076 | A | * | 12/1997 | Humber | 248/57 |
| 5,788,294 | A | * | 8/1998 | Leon et al. | 292/307 R |
| 6,174,006 | B1 | | 1/2001 | Burt | |

* cited by examiner

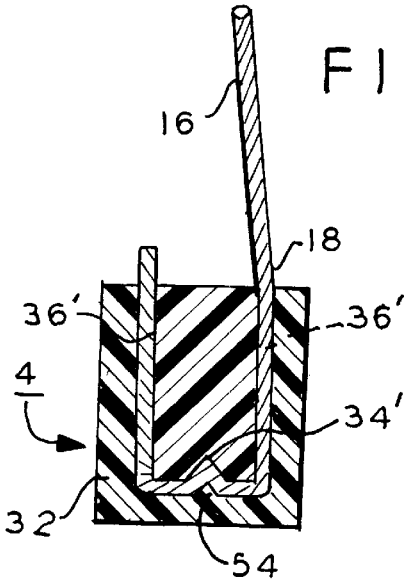
FIG. 2
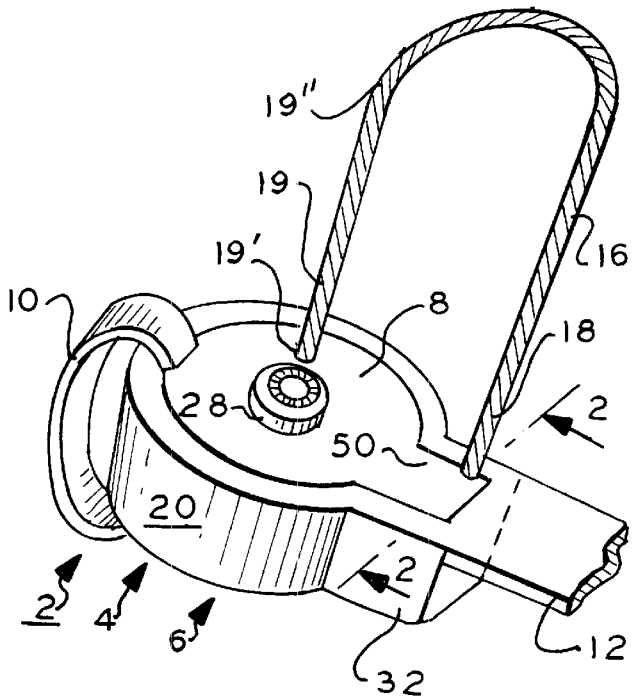
FIG. 1
FIG. 3b
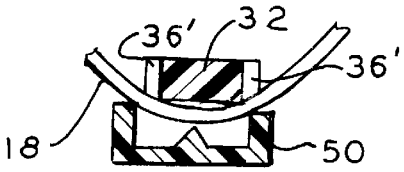
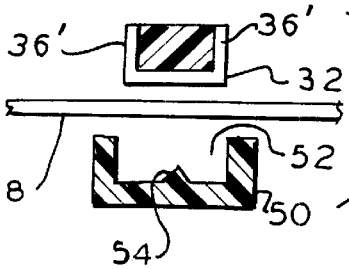
FIG. 3a
FIG. 13
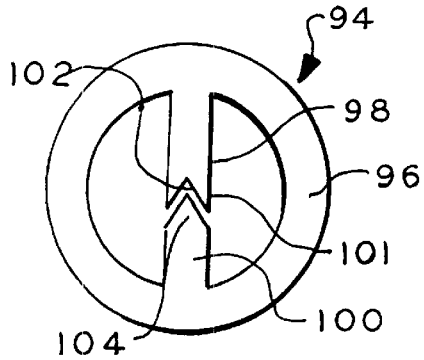
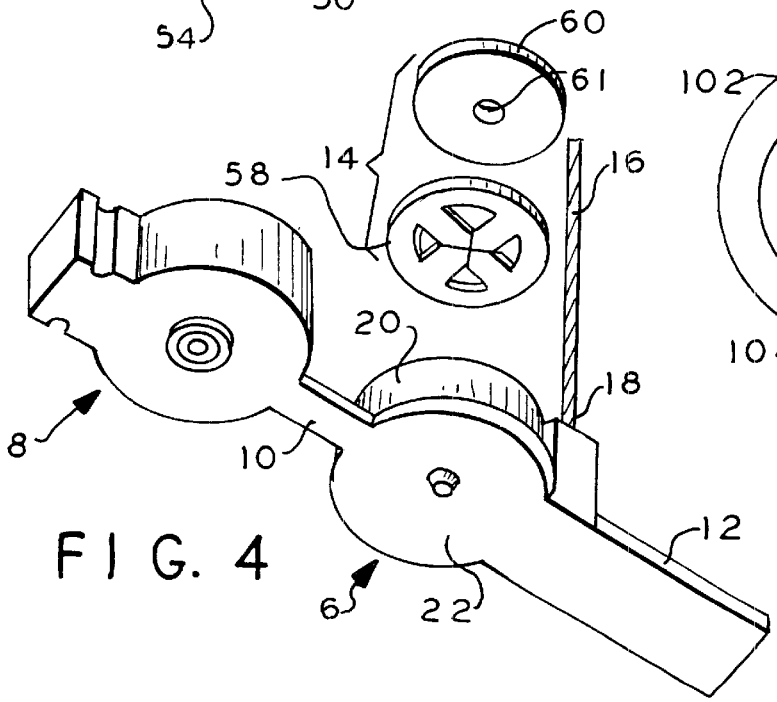
FIG. 4

FIG. 16
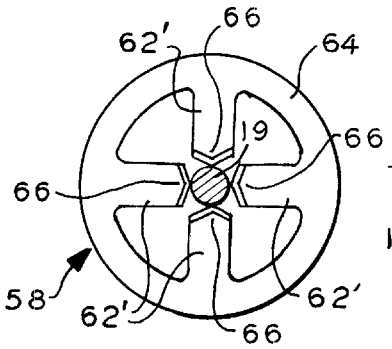
FIG. 18
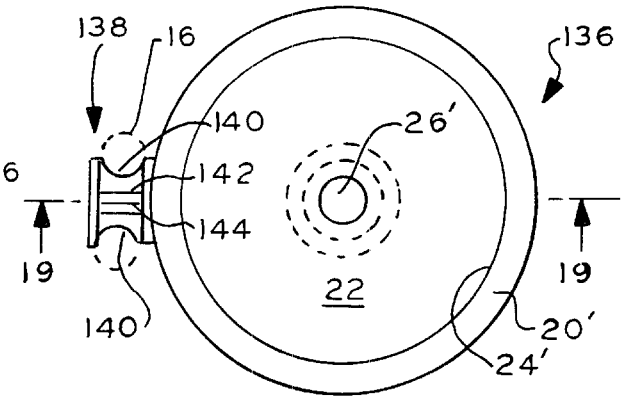
FIG. 17
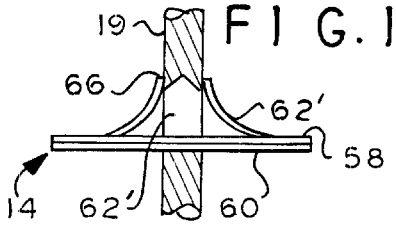
FIG. 19
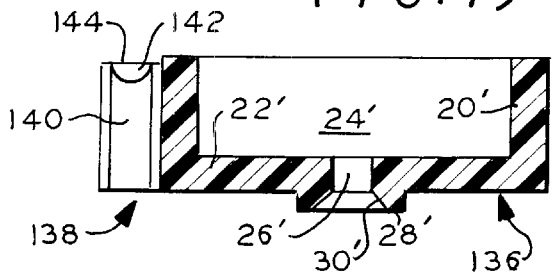
FIG. 20
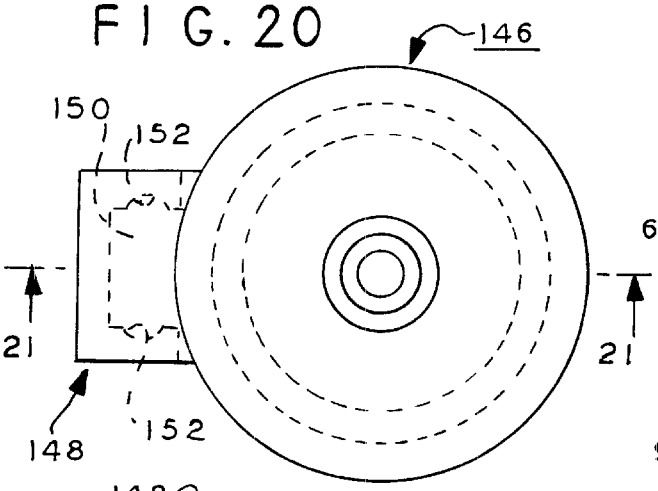
FIG. 14
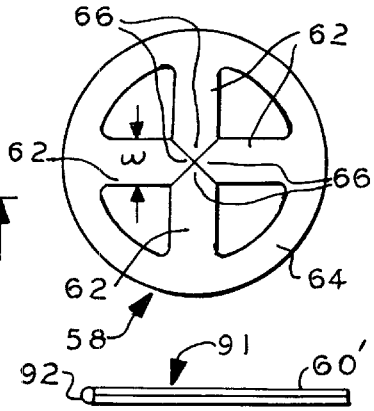
FIG. 15
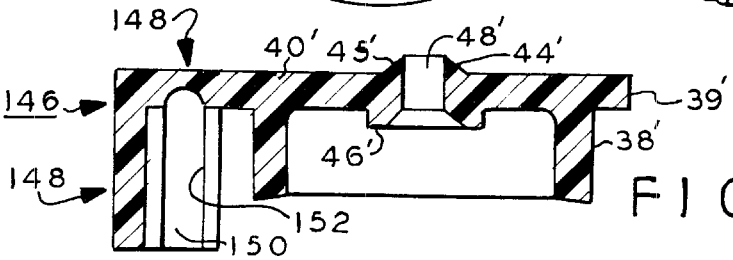
FIG. 21

TAMPER EVIDENT SECURITY SEAL

This invention relates to security seals of the type wherein a filament is passed into or through a seal body in engagement with a metal locking element located within the body.

Numerous fasteners and seals are known wherein a sheet metal locking member has teeth which engage and grip a filament, shaft or stud inserted there against. For example, U.S. Pat. No. 2,356,856 to Komenak discloses a detection seal including a tie wire, a cup shaped closure member with an opening for receiving the wire, a cover with an opening through which the wire passes and a detent plate with resilient lips. The wire passes between the lips by threading the wire into the device. The lips flex when the wire is pushed between them. The wire can not be removed in the reverse direction as the lips dig into the wire. The detent plate can shift to permit alignment of the holes with the lips. The lips have parallel straight edges and the detent plate has a relatively large surface. However, it appears that the wire could be unthreaded from the locking engagement with the lips in the same manner it was inserted. This unlocking would defeat the seal and is unsatisfactory.

U.S. Pat. No. 2,740,654 to Orschel discloses a cord seal lock wherein a leaf spring engages a cord at a toothed edge of the spring. An attempt to remove the cord results in the leaf spring edge teeth digging into the cord and preventing its removal. However, it appears that the wire may be removed by a threading action which is undesirable.

U.S. Pat. No. 881,407 to Jewett discloses a bag seal comprising a tubular member with inner facing barbs for gripping a cord in the channel of the member.

U.S. Pat. No. 2,140,320 discloses locking tongues formed in a spring plate which engage a U-shaped shackle. The tongues form lips which indent into the softer shackle, the tongues being enclosed in a cup shaped members.

U.S. Pat. No. 2,458,409 discloses an outlet box connector with spring fingers of different lengths for engaging a cable and securing the cable to an electrical box.

U.S. Pat. No. 5,702,076 discloses an insulator for mounting pipe in a metal wall stud. The device has a plurality of pie shaped gripping segments for gripping a pipe. The segments deflect when the pipe is inserted therebetween.

Also, fastening devices, known as Tinnerman fasteners, employ sheet metal nuts having inner edges used to grip threads so that the nut although sheet metal, can lock to the threads as a nut with multiple axially extending threads. Also, cap type fasteners are known, referred to as speed nuts, which slip over a shaft and grip the shaft with deflecting fingers. This device is not used as a seal.

The problem with all of the above arrangements is that the wire, pipe, cord and so on may be twisted free from the locking engagement. This is undesirable in a security seal wherein it is desired that the seal be broken in order to open it so as to provide evidence of tampering. The present invention is a recognition of a need for a low cost seal wherein a wire or filament severs in order to remove it and the wire or filament can not be twisted free.

A seal according to the present invention which overcomes the above noted problems with the prior art seals comprises a filament; a housing defining a first chamber with a first opening having a transverse dimension, the filament for being received in and passing through the opening into the chamber; and a spring metal filament first locking insert captured in the chamber, the insert having a plurality of radially inwardly extending resilient fingers each of a transverse width and terminating at a tip, at least one of the tips tapering to substantially a point, the tips defining a region therebetween smaller than the filament thickness, the filament for being received in the region in a first insertion direction through the opening, the filament for abutting and flexing the tips such that the tips impose a resilient compressive load against the inserted filament, the filament and insert being of relative hardness such that the at least one tip point digs into the received inserted filament in response to withdrawal of the filament from the chamber in a second direction opposite the first insertion direction such that the filament is severed as the filament is withdrawn. As a result, the severed filament provides tampering evidence.

In one aspect, the chamber and the insert are arranged so that the insert rotates in response to rotation of the inserted received filament at least in response to a force on the insert by the inserted filament in the second withdrawal direction. Thus any attempt to remove the filament by twisting is of no effect because the insert will also rotate with the filament. The insert rotates because the tips digging into the filament provide a grip sufficient to permit a torque to be applied to the insert via the tips. In contrast, a flat edge engagement with the filament as in the prior art devices employing straight gripping edges or relatively large radii on the gripping edges can not receive a sufficient rotational torque from the rotating filament as the filament will merely slide against the edge as the filament rotates.

In a further aspect, the insert comprises an annular array of the fingers, a plurality of the fingers of the array each having a tip tapering substantially to a point.

In a further aspect, at least two fingers have nested complementary tips.

In a further aspect, the insert is a circular element and includes an annular array of identical fingers each with a tip tapering to the point.

In a further aspect, all the tips abut each other in a plane.

In a still further aspect, the filament has a transverse thickness and the tips are in close but spaced relationship, which spaced relationship defines a transverse space substantially smaller than the filament thickness.

In a still further aspect, the insert has a flat periphery lying in a plane with the fingers biased out of the plane and having a given thickness, the fingers each being defined by a radial dimension and a dimension transverse the radial direction which transverse dimension is substantially larger than the given thickness.

Preferably, the housing opening has a transverse dimension, further including a support member in the chamber between the housing opening and the insert, the support member having an aperture for receiving the filament therethrough, the aperture having a transverse dimension smaller than the transverse dimension of the housing opening, the support member for precluding bending of the fingers in the second direction in response of a force applied to the received filament in the second direction.

Preferably the at least one finger has a width and a length forming a rectangular member, the tip being at a radially inward end of the length.

In a further aspect, the insert and fingers lie in a plane, the transverse width of the fingers and the thickness thereof being sufficiently great to preclude lateral circumferential twisting of the fingers in the plane in response to rotation of the inserted filament secured thereto.

In a further aspect, a first portion of the fingers has a first length and a second portion of the tips have a second length different than the first length, the tips of all of the fingers abutting and being complementary to each other.

Preferably, the insert is a circular disk and all of the tips mate at the center of the disk in complementary symmetrical pointed fashion. In addition, the insert preferably is flat at the periphery with the fingers biased away from the plane of the periphery and have a given thickness, the fingers each being defined by a radial dimension and a dimension transverse the radial direction which transverse dimension is substantially larger than the given thickness.

In a further aspect, the housing opening has a transverse dimension, the seal further including a support member in the chamber between the housing opening and the insert, the support member having an aperture for receiving the filament therethrough, the aperture having a transverse dimension smaller than the transverse dimension of the housing opening, the support member for precluding bending of the fingers in the second direction in response of a force applied to the received filament in the second direction. Thus, with the support member present, during withdrawal, the tapered tips of the fingers, which fingers are weak, can not be bent in a reverse withdrawal direction so as to permit the filament to be withdrawn from the seal. Preferably, the insert is a hardened spring steel flat disk and the support member is a hardened spring flat steel disk.

In a further aspect, a connecting element hinges a first housing member to a second complementary housing member, the housing being one piece molded thermoplastic.

In a further aspect, the housing includes two complementary housing portions, a first portion has a cavity and a second portion has a male projection located in the cavity, an end of the filament being located in the cavity between the first and second portions, the housing including a rib member in the cavity for locking the filament end to the housing.

In a still further aspect, the filament has first and second end portions, the first end portion being secured to the first insert in the first chamber, the housing having a second chamber and a second opening in communication with the second chamber, further including a second insert identical to the first insert in the second chamber for receiving the second end for selectively locking the second end to the housing. Thus a padlock type seal may be provided in this embodiment.

In this embodiment, each insert is a steel circular disk, each chamber being circular cylindrical and elongated defining a longitudinal axis, each chamber having an annular recess for receiving the corresponding insert, the recess for releasably retaining the corresponding insert axially in the respective chamber.

In a further aspect, the housing comprises a body including first and second portions, the first opening being in the first portion and the second opening being in the second portion, the body including a third portion having the chambers, the first and second portions being coupled to the third portion by weakening means such that the first and second portions will selectively independently sever from the third portion in response to a withdrawal force on the corresponding insert by the filament. Thus in this aspect, the body portions when separated provide tamper evidence rather than a severed filament since in a padlock arrangement the filament may be a solid wire that is difficult to sever.

In a seal having a housing, a locking insert captured in the housing according to a further aspect of the invention comprises a circular cylindrical disk having a plurality of rectangular radially inwardly extending fingers each finger terminating at a tapered pointed tip, the tips being adjacent and complementary; a tip support member having a central aperture aligned with the complementary pointed tips for receiving a filament therethrough; and means for securing the support member to the disk.

IN THE DRAWING

FIG. 1 is an isometric view of a seal according to one embodiment of the present invention;

FIG. 2 is a sectional view of the embodiment of FIG. 1 taken along lines 2—2;

FIGS. 3*a* and 3*b* show different stages of assembly of the arrangement shown in FIG. 2

Figure 5:
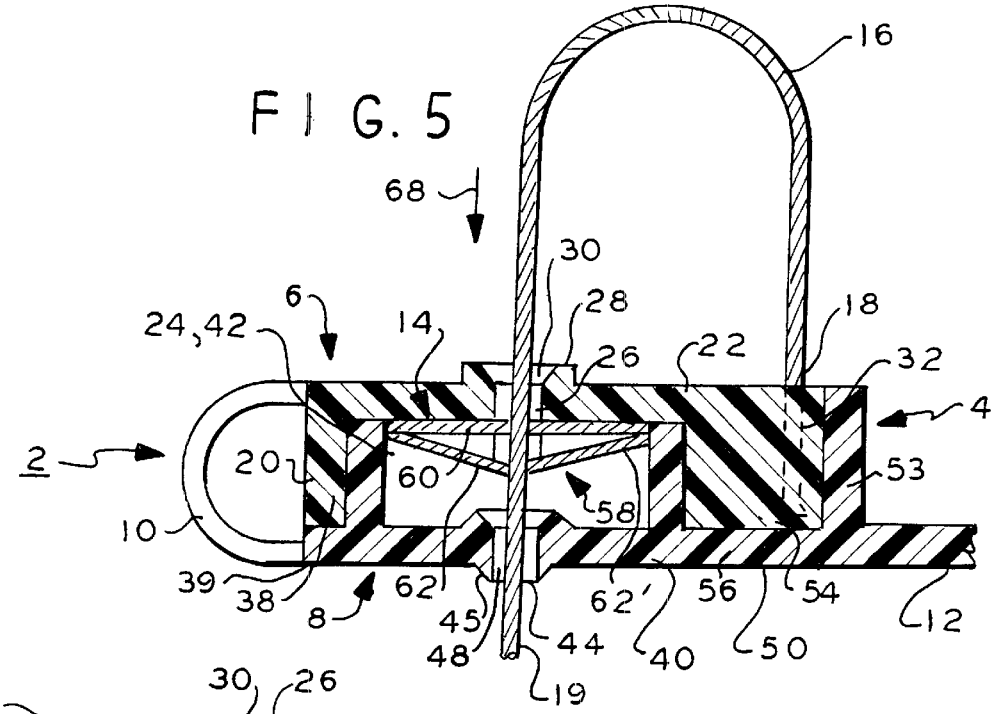
Figure 7:
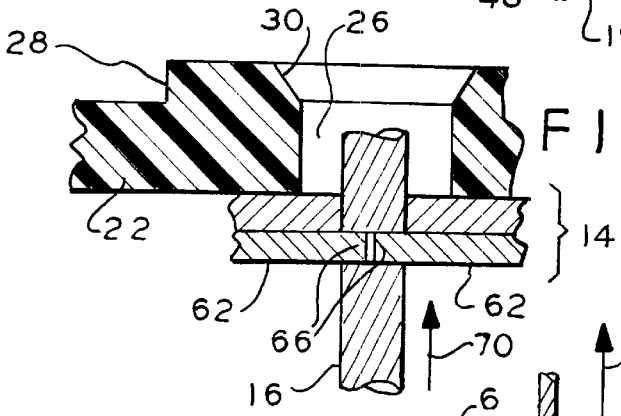
Figure 6:
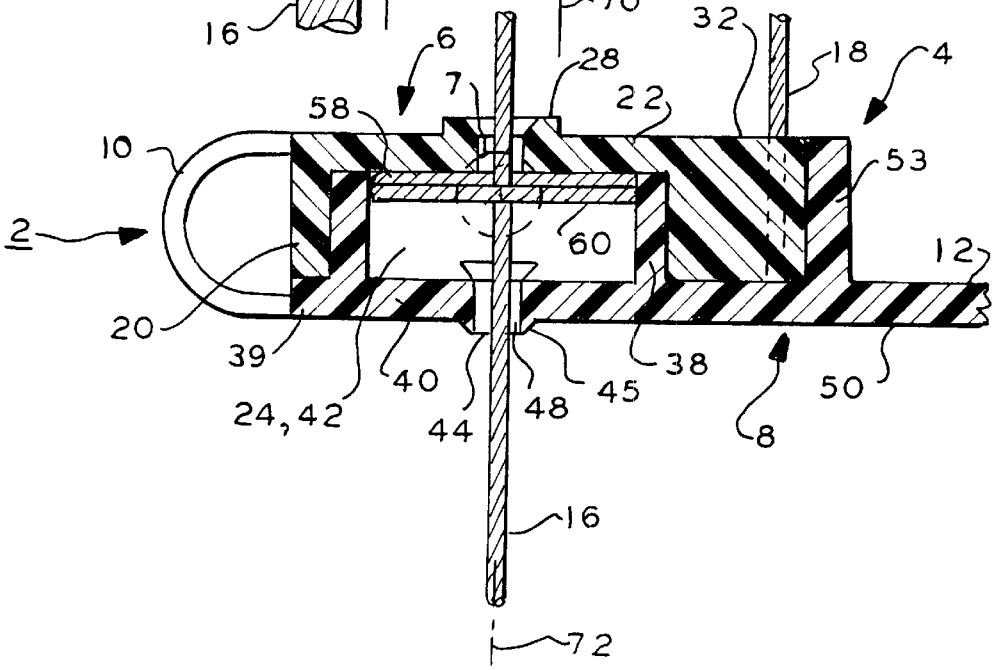

FIG. 4 is an exploded view of the seal of FIG. 1 prior to closure of the two segment housing;

FIG. 5 is a sectional side elevation view of the seal of FIG. 1 in a locked state;

FIG. 6 is a sectional side elevation view similar to that of FIG. 5 showing the position of the parts when the filament is attempted to be withdrawn from the seal;

FIG. 7 is a more detailed view of the seal of FIG. 6 taken at region 7

Figure 8:
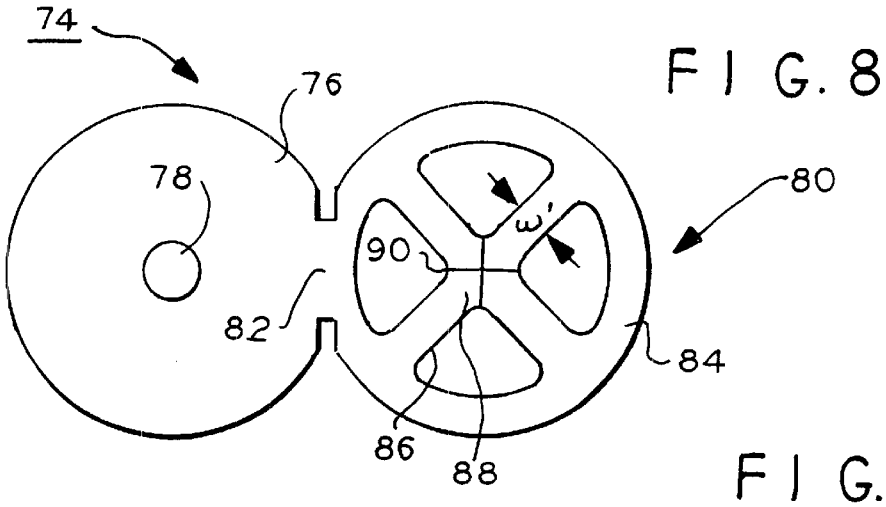
Figure 9:
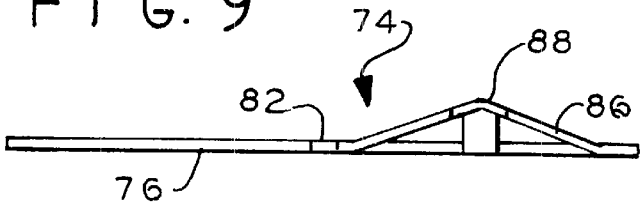
Figure 10:
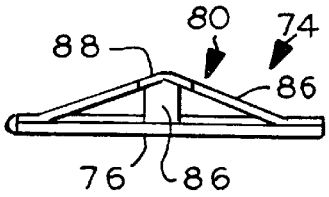
Figure 11:
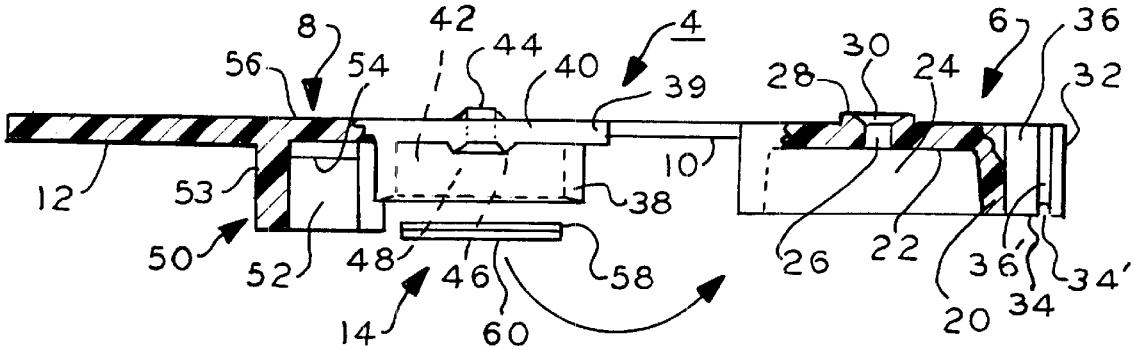
Figure 12:
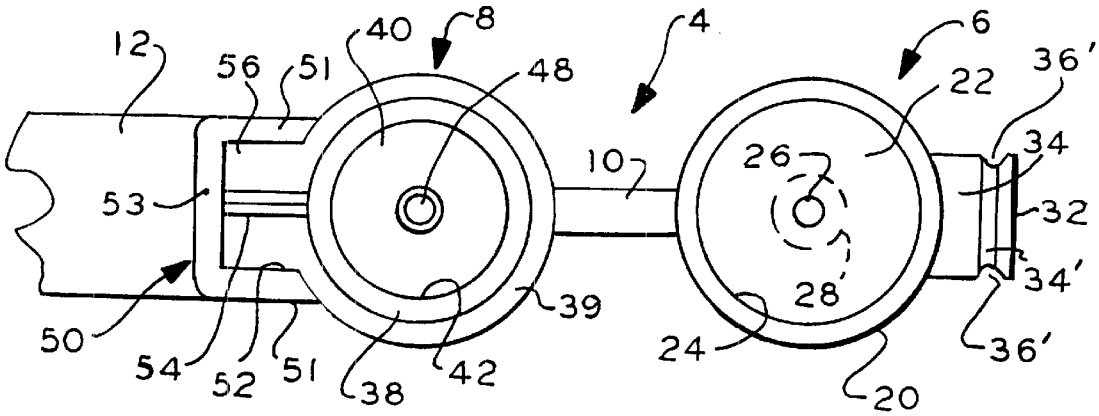
Figure 26:
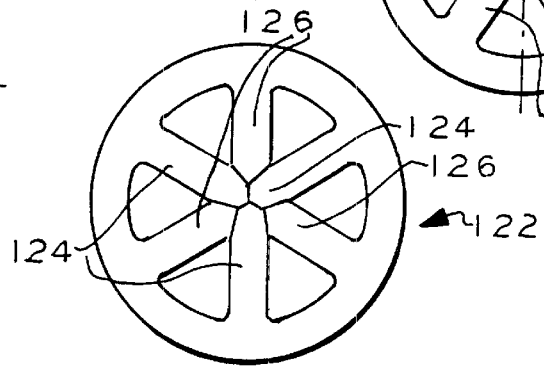
Figure 28:
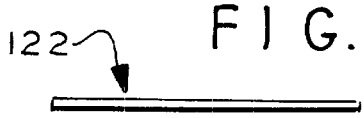
Figure 29:
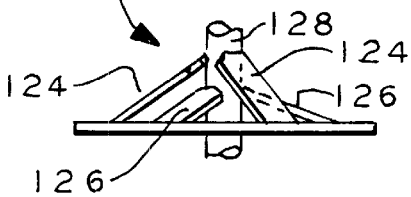
Figure 30:
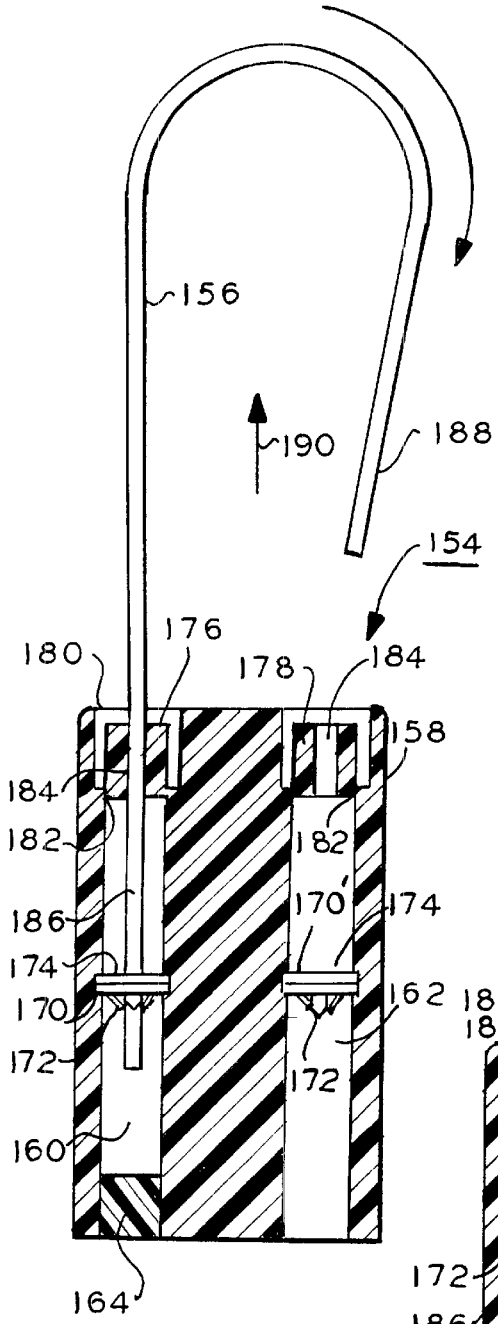
Figure 31:
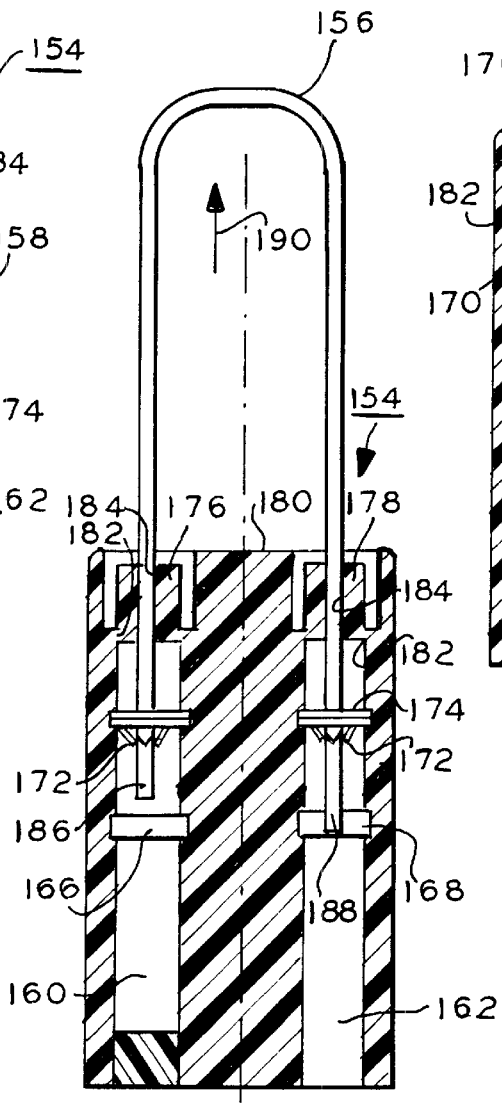
Figure 32:
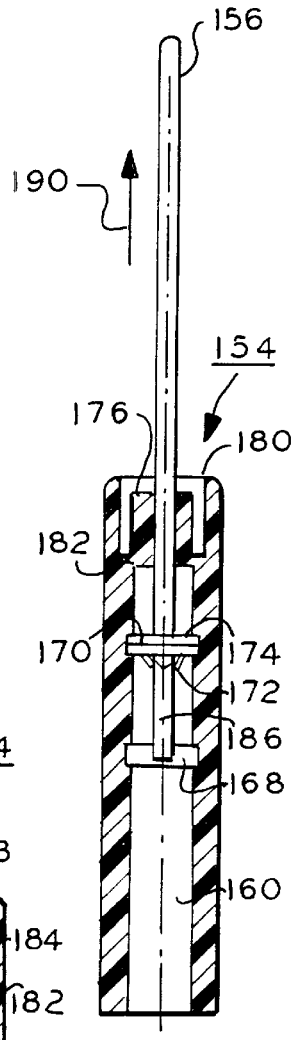
Figure 34:
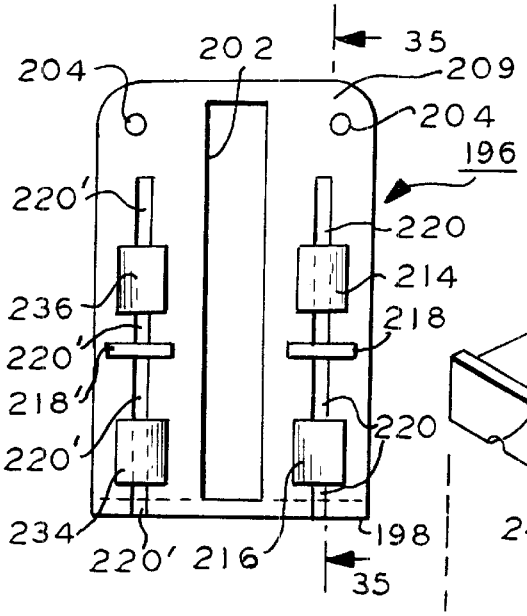
Figure 33:
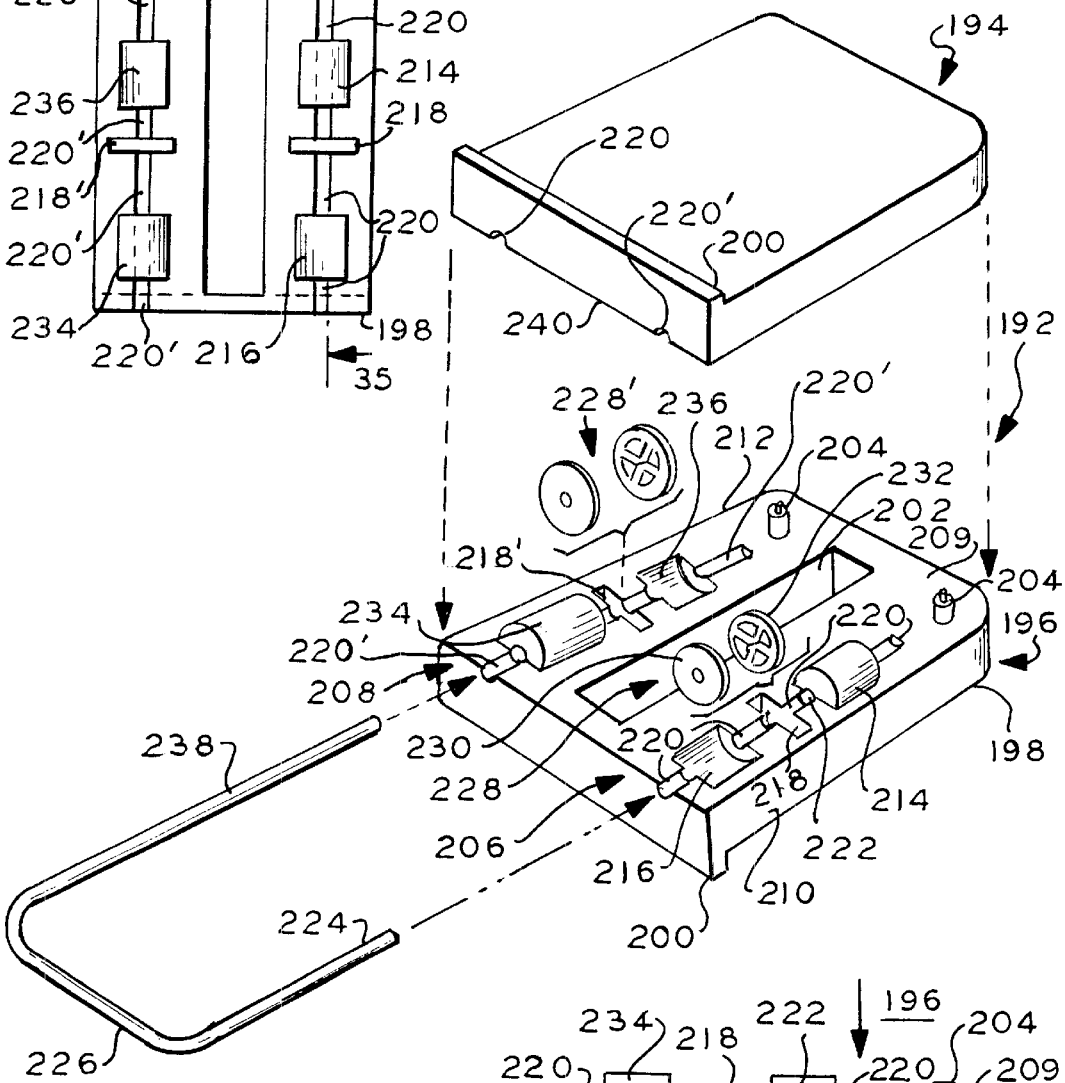
Figure 35:
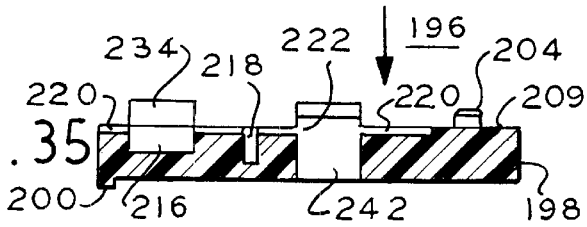
Figure 36:
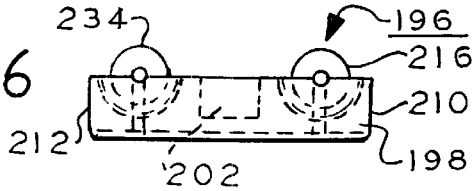

FIG. 8 is a plan view of an embodiment of an insert that may be used in the seal of FIG. 1;

FIG. 9 is a side elevation view of the insert of FIG. 8;

FIG. 10 is a side elevation view of the insert of FIG. 9 after it is folded into its final configuration for use with the seal of FIG. 1;

FIG. 11 is a side elevation exploded view partially in section of the housing of FIG. 4 with a further insert embodiment;

FIG. 12 is a plan view of the housing portion of the embodiment of FIG. 11;

FIG. 13 is a plan view of an insert according to a further embodiment of the present invention;

FIGS. 14 and 15 are respective plan and side elevation views of an insert according to a further embodiment of the present invention;

FIGS. 16 and 17 are respective plan and side elevation views partially in section of the insert of FIGS. 14 and 15 with a filament assembled thereto;

FIGS. 18 and 19 are respective plan and side elevation partially in section views of a first housing segment according to a further embodiment of the present invention;

FIG. 20 and 21 are respective plan and side elevation partially in section views of a second housing segment that mates with the first segment of FIGS. 18 and 19 to form a seal housing;

FIGS. 22–27 are plan views of inserts according to further embodiments of the present invention;

FIG. 28 is a side elevation view of the insert of FIG. 26;

FIG. 29 is a side elevation view of the insert of FIG. 26 with a filament inserted therein;

FIG. 30 is a side sectional elevation view of an open padlock type seal according to a further embodiment of the present invention;

FIGS. 31 and 32 are front and side elevation sectional views of the seal of FIG. 30 in the locked state,;

FIG. 33 is an exploded view of a seal according to a still further embodiment of the present invention;

FIG. 34 is a plan view of the lower housing segment of the seal of FIG. 33;

FIG. 35 is a side elevation sectional view of the segment of FIG. 34 taken along lines 35—35; and FIG. 36 is a n end elevation view of the segment of FIG. 34.

In FIG. 1, seal 2 comprises a preferably one piece molded thermoplastic housing 4. Housing 4 comprises an outer female segment 6 and an inner male segment 8. The two segments are interconnected by a flexible strip interconnection member 10. A flat sheet member flag 12 extends from the segment 6 for receiving indicia such as a bar code or serial number and so on. The seal 2 also includes interior of the housing a locking insert 14, FIG. 4. A filament 16, which may be stranded steel cable, solid wire or plastic material, but preferably in this embodiment stranded metal 3 ply strands, has one end 18 secured to the housing 4 and a free end 19 which is selectively inserted into and through the housing 4 and locked to the housing 4 by the insert 14.

In FIGS. 11 and 12, housing 4 female segment 6 comprises a circular cylindrical side wall 20 and a circular disk bottom wall 22 forming chamber 24. The bottom wall has a through bore opening 26. A boss 28 extends from the exterior surface of the bottom wall 22. The bore opening 26 extends through the boss and has a tapered surface 30 in the boss 28 to facilitate the insertion of a wire filament free end 19 into the chamber 24. A rectangular extension 32 extends laterally from the side wall 20 and is integral one piece therewith. The extension has a top surface 34 and two oppositely disposed side surfaces 36. A semi-circular groove 34' is in the top surface and a similar groove 36' is in each of the side surfaces 36. The grooves 34' and 36' closely receive the filament 16 end portion 18 (FIG. 1).

Male housing segment 8 comprises a circular cylindrical side wall 38 and a circular disk base wall 40 which walls form a chamber 42. The base wall 40 is larger in diameter than the side wall 38 forming an annular flange 39. A projection 44 extends from the exterior surface of the base wall 40. A further projection 46 extends interior of chamber 42 from the base wall 40. A through bore 48 passes through the projections 44 and 46 and base wall 40. An extension 50 extends laterally from the side wall 38. The extension has side walls 51 and 53 forming a cubic-like chamber 52. A rib 54 extends from the chamber 52 bottom wall 56 into the chamber 52. The rib 54 is V-shaped in cross section with the V edge in the chamber 52. The flange 12 extends outwardly from the bottom wall 56 and side wall 53 in a direction away from the segment 4.

Insert 14 comprises two elements, FIG. 4, including a lock element 58 and a mating support element comprising a preferably steel flat circular washer 60. In FIG. 14, lock element 58 comprises a hardened spring steel flat circular disk. The element 58 may be stainless steel spring metal for example. Element 58 has four radially inwardly extending identical locking fingers 62. The fingers 62 extend cantilevered radially inwardly from a peripheral circular rim 64. The fingers 62 each are rectangular for most of their radial length and terminate in identical tapered tips 66 forming filament locking teeth having sharp pointed ends.

The filament is inserted between the tips 66 to lock the filament to the insert 14 element 58. The tips 66 in this embodiment abut each other in complementary fashion as shown, and may be spaced in other embodiments as will be explained in connection with the embodiment of FIG. 22. The element 58 preferably is about 0.005 to 0.040 inch (0.13–1 mm) thick type 301 stainless steel of about 15000 psi tensile strength and more preferably about 0.007–0.010 inches (0.18–0.25 mm) thick for use with 3 ply stranded filament steel wire of about 0.010–0.020 inches (0.25–0.5 mm) diameter. Thicker material for the element 58 may be employed with larger diameter filaments. The relationship of the element 58 thickness to the wire filament diameter may be determined empirically for a given implementation. The shape and dimensions of the fingers is important as will be explained.

For a 0.287 inch (7.3 mm) diameter disk element 58, the fingers 62 preferably have a transverse width of about 0.030 (0.76 mm) to about 0.060 inches (1.5 mm) for use with stranded steel 3 ply filaments in the range of about 0.030 to 0.060 inches in diameter. The transverse width of the fingers is generally about the same as the filament diameter. However, it is the thickness of the material of the element that is important in determining the locking strength of the element 58. Also, it is important that small diameter filaments be easily inserted between the teeth formed by the locking tips 66.

Small diameter filament wires do not have large compressive load capability in the axial direction of the longitudinal axis of the filament. The wire is inserted in the axial direction. Thus an end tip portion 19', FIG. 1, of the wire extends from where the wire is gripped for insertion into the seal, for example at about region 19". If there is a large insertion force required, the wire will bend in the region between regions 19' and 19", i.e., where the wire first engages the element 58 and where it is gripped for insertion. It will be difficult to insert the wire filament 16 into the region between the tips 66, FIG. 14, if the insertion force is too high. For this reason, the tips 66 must bend in response to an insertion force of about 2–3 lbs. (0.9–1.3 kilogram) for small diameter filaments, e.g., filaments of about 0.010 to 0.040 inches (0.25–1.0 mm) in diameter. The length of the fingers 62 and their rectangular shape thus increase the axial flexibility of the fingers when a torque is applied to the tips 66 during insertion of the filament 16 between the tips. The finger thickness, width and length thus contribute to its flexibility in the axial direction normal to the plane of the element 58. Preferably, the radial length of the tips 66 between their points and the junction with the rectangular sections is about the same as the radius of the filament being used with the element 58. Thus the diameter of the circumferential region circumscribed by the tips 66 at their junction with their rectangular sections is about the diameter of the filaments to be used therewith. This diameter is smaller than the diameter of the opening 26 and bore 48 in the housing segments of FIGS. 11 and 12.

The washer 60, FIG. 4, has a thickness preferably the same as the locking element 58, is made of the same material as the locking element, and has a central aperture 61 of the same diameter as that formed by the finger-tip arrangement, e.g., a tip of 0.050 inch (1.3 mm) transverse maximum width w, FIG. 14, corresponds to a 0.050 inch diameter aperture in the washer 60. The housing 4, FIGS. 11 and 12 may have a bore opening 26 and bore 48 diameters of about 0.055 inches (1.4 mm) for such dimensioned locking element fingers and washer. The washer forms a support for the tips in the withdrawal direction of the filament so that the tips do not bend in the reverse direction during withdrawal of the filament.

To assemble the seal 2 of FIG. 1, the filament 16 end 18 is placed adjacent to the extensions 32 and 50, FIG. 3*a*. The extension 32 is then inserted into the chamber 52 of extension 50. The filament end 18, FIG. 3*b*, is squeezed between the two extensions and forced into the chamber 50 by extension 32. During this time the filament seats in the grooves 34' and 36' of extension 32. At this time the rib 54 engages the inserted filament 18 and the edge of the rib 54 depresses into the filament somewhat locking the filament 18 between the two extensions in the chamber 52, FIG. 2.

At the same time, the male housing segment 8, FIG. 11, is inserted into the chamber 24 in the female segment 6 with the insert 14 being positioned in the chamber 42 of the male segment 8. The element 58 is between the base wall 40 of the male segment and the washer 60. In the closed assembly, FIG. 5, the washer 60 is next adjacent to the bottom wall 22 of the female segment 6 between the element 58 and wall 22. The circular side wall 38 of the segment 8 is nested within the outer circular side wall 20 forming chamber 24 of the female housing segment 6. The bottom wall 22 and base wall 40 enclose the chambers 24, 42 of the housing segments with their side walls juxtaposed. The two housing segments are then heat welded together at side wall 38 and bottom wall 22.

In operation, the filament end 19 is inserted through an article to be sealed (not shown) and then inserted into the housing 4 through bore 26 in engagement with the insert 14 locking element 58. The chamfered bore 26 indicates to a user that this is the hole in which the filament is to be inserted. The bore 48 in projection 44 on the opposite side of the housing is not as easily accessible for filament insertion because it does not have a chamfered entrance. Also, the exterior region 45 of the projection 44 is tapered making it more difficult to insert the filament into the bore 48.

The filament 16 end 19, FIG. 5, is inserted with the end 19 passed through the opening 26 in boss 28, between the finger tips 66 of fingers 62, through the aperture 61 of the washer 60 and through bore 48 in insertion direction 68. In FIGS. 16 and 17, the filament end 19 bends the fingers 62' with the sharp points of the tips 66 digging somewhat into the filament. The fingers bend because there is no room for the filament between the normally abutting tips.

When the filament 16 is attempted to be withdrawn in withdrawal direction 70, FIG. 6, the fingers tend to return to the flat state. Because the fingers are harder than the filament they dig further into the filament and cut the filament, severing it. In FIG. 7, for example, the flattened fingers 62 force the tips 66 further into the filament. Because the tips in the flat state abut (or are closely spaced substantially smaller than the diameter of the filament as will be described below), they cut and sever the filament.

The insert 14 being circular and located in the circular chamber 42 of the housing segment 8 (FIGS. 11 and 12) will rotate when the filament is rotated in an attempt to withdraw the filament in the withdrawal direction 70, FIG. 6. The sharp points of the tips each dig into the filament even prior to any attempt to withdrawn the filament due to the sharpness of the tip points. This digging action grips the filament to the insert. This prevents the filament from sliding about the insert. This gripping occurs even if there may be some friction between the insert and the housing 4 during rotation of the filament about its longitudinal axis. 72, FIG. 6.

In the alternative, the insert may also be aluminum in accordance with a particular implementation. In one test, the seal held up to 39.7 lbs. (18 kilograms) with a filament 3 ply steel wire having a 40 lb. breaking strength. This means the wire fractured first before the insert fingers broke. If a finger tip breaks then the wire filament may break free. No washer was used.

For this reason, the washer backs the fingers 62 and prevents the tips from bending in the reverse withdrawal direction, preventing the tips from breaking and causing the seal to fail. Thus the sharp teeth of the tips 66 provide an advantage over prior art devices in which the filament gripping edges of an insert are either flat straight edges or have a relatively large radius, i.e., are curved. Because the tips of the present insert are interlocking in complementary fashion, as the wire filament is withdrawn, the tips do not leave room for the filament as shown in FIG. 7. The abutting tips of a given insert provide a large tolerance for filament diameters and will work with a wide range of filament diameters.

The relatively thin (transverse width of the fingers) fingers permit a relatively small insertion force on the filament to provide a sealing action. Prior art triangular spaced apart gripping elements do not provide such flexibility and are relatively stiff providing a high insertion force. Also, such tips do not abut or are not closely spaced for severing a filament therebetween. Their relatively large radii at the gripping edge do not dig into the filament to prohibit relative rotation of the filament thereto. The present fingers because they are rectangular provide a higher degree of flexibility than triangular fingers. The flexibility is controllable by providing the length thereof accordingly. Increasing the length of triangular fingers does increase their flexibility in the normal direction to the plane of the fingers In addition, the transverse width and thickness of the locking insert element fingers is important to preclude twisting of the fingers in their plane as the filament is rotated. These parameters need to be set at the values which will not permit such laterally distortion of the fingers. For these reasons, fingers of the dimensions given above for use with filaments of the dimensions also given above are optimum for precluding failure of the seal device. Preferably the tips 66 side edges taper to the point at an angle of about 90°.

While steel inserts and filaments are described above, other material may also be used including aluminum, plastics and so on. What is important is the relative strengths of the material used, their stiffness and flexibility and ability to withstand the stresses of the intended use. By making the insert fingers symmetrical, orientation of the insert is not a problem during assembly. It is important that the housing not be too soft relative to the insert locking element used without a washer and filament material. If the housing is too soft, the insert element may dig into the housing when rotated and the friction will prevent the insert from rotating, permitting the filament to be threaded free of the insert. Thus the washer 60 is used with thermoplastic housings to prevent such defeat of the seal. The insert locking element can rotate against the washer and will not dig into a thermoplastic housing. The washer when rotated with the locking element will not dig into the plastic housing and minimize friction therewith. It is important that the locking insert rotate with the filament to preclude tampering defeat of the seal. The housing chamber 24 is sufficiently large in depth in the axial direction to permit the fingers to bend during insertion of the filament.

In FIGS. 8–10, a preferred alternate embodiment of an insert 74 is illustrated. The insert 74 comprises a flat hard 301 stainless steel thin sheet material, e.g., 0.007–0.010 inch (about 0.2 mm) thick. The insert includes a washer 76 with a central aperture 78 joined to a locking element 80 by an integral one piece flexible bendable hinge member 82. Element 80 comprises an outer circular rim 84 having an inner diameter of about 0.219 inches (about 5.5 mm) and an outer diameter of about 0.287 inches (about 7.3 mm). The fingers 86 terminate at sharp pointed triangular tips 88, the fingers having a transverse circumferential width w' of about 0.035 inches (0.9 mm). The tips 88 are slightly wider at their widest region than the fingers 86 due to the radii 90. The tips 88 inter-engage and abut in the flat state.

The fingers 86 are bent with a bias as shown in FIGS. 9 and 10. The fingers are bent at an acute angle to the plane of the rim 84. As a result, the tips are spaced from each other slightly. The biased fingers are oriented in the housing 4, FIG. 5, with the bias extending as shown away from the washer 76 and wall 22 of the housing 4. The bias reduces the insertion force further. In FIG. 10, the washer 76 is bent over at the hinge member 82 and is juxtaposed with the locking element 80. An insert 91, FIG. 15, such as insert 14 of FIG. 4, in the alternative, may also comprise one piece sheet material with a hinge member 92, FIG. 15, joining the washer 60' and locking element 58', the primed numbers referring to otherwise identical structure with the identical reference numerals without the prime as in the insert 14.

In FIG. 13, an alternative insert 94 is shown formed of sheet stainless steel of about 0.005 inch (0.13 mm) thickness with a circular rim 96 of about 0.281 inch (7 mm) outer diameter and 0.221 inch (5.6 mm) inner diameter and two complementary fingers 98 and 100. Finger 98 terminates at its tip 101 in a bifurcated V-shaped notch 102. Finger 100 terminates in a triangular tip 104 nested in spaced relation to the tip 101 in the notch 102. The fingers are about 0.10 inches (2.5 mm) wide and formed by edges that subtend an angle of about 50°. The tips 101 and 104 are spaced apart about 0.005 inches (0.13 mm).

Figure 22:
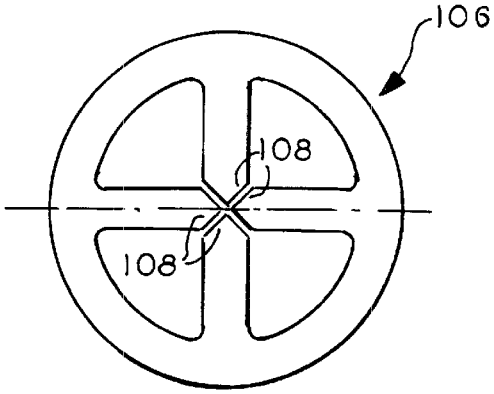

FIGS. 22–29 illustrate still other embodiments of inserts according to the present invention. FIG. 22 shows an insert 106 with four fingers at right angles to each other and having tips 108. The tips 108 are space from each other in nested complementary relation about 0.005 inches. This spacing permits the use of mating filaments of greater diameter than abutting tips. The insert has thickness and rim dimensions otherwise as given above for the insert of FIG. 13. The fingers may have a width of about 0.055 inches (1.4 mm).

Figure 23:
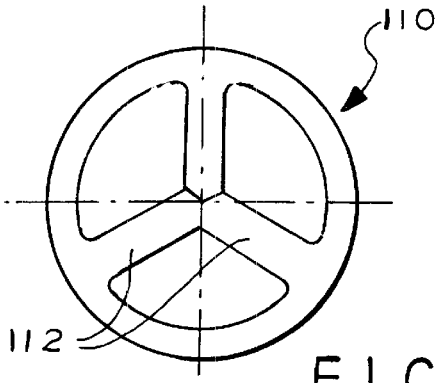
Figure 24:
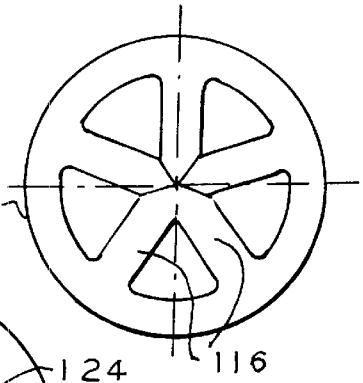
Figure 25:
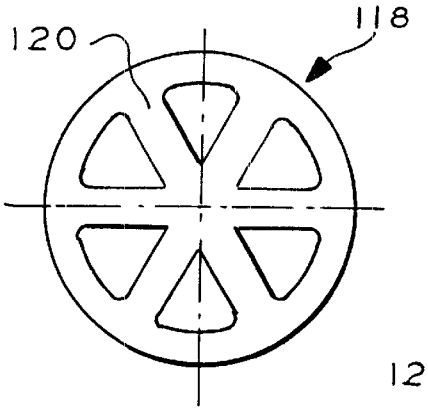

In FIG. 23, the insert 110 has the same overall dimensions of the insert of FIG. 22 except the fingers 112 abut at the tips and there are three fingers symmetrically placed about the insert. The insert 114 of FIG. 24 is of the same dimensions as the inserts of FIGS. 22 and 23 except there are five fingers. Similarly, the insert 118 of FIG. 25 is of the same dimensions of the above noted inserts but has six fingers 120.

The insert 122 of FIG. 26 is somewhat different than the above described inserts. The insert 122 has three fingers 124 that have tips that terminate in the center in abutting relation. The other three fingers 126 do not abut at the center of the insert. Each finger 126 terminates at its tip adjacent to and abutting one side of the tips of two adjacent fingers 124 so that the fingers 126 are shorter than fingers 124. In FIG. 29, this arrangement of longer and shorter fingers results in a two level gripping of the fingers on the filament 128. This two level gripping provides an enhanced gripping of the filament which in any case will sever upon withdrawal from the insert. FIG. 28 shows that the insert 122 is a flat sheet member without the filament attached.

Figure 27:
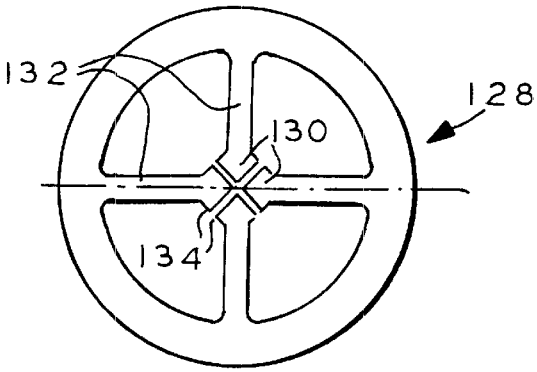

FIG. 27 shows an insert 128 which is similar to insert 80, FIG. 8, without the washer attached and with longer thinner fingers that have tips that are spaced apart preferably about 0.005 inches(0.13 mm). Four fingers are shown wherein the tips 130 are wider than the rectangular finger portions 132. Also, the tips 130 form angular side points 134 to increase the tip widths. All of the above described inserts form locking elements preferably for use with a tip support washer as described.

In FIGS. 18 and 19, primed reference numerals refer to identical structure in the housing 4 of FIGS. 5, 6, 11 and 12 with the same unprimed reference numerals. Female housing segment 136, except for filament locking extension 138 and the absence of flag 12, may be identical to female locking segment 6 of FIGS. 5, 6 and 11. Extension 138 has two oppositely placed grooves 140 for receiving the filament 16. Located between the two grooves 140 is a rib 142. The rib 142 terminates at an edge formed by a V-shaped transverse section.

Male segment 146 has an extension 148 with a chamber 150 for receiving the extension 138 of segment 136. The extension 148 has opposite grooves 152. The grooves 140 and 152 cooperate to receive the filament 16 therein at end 18 when the two segments are mated as in the embodiment of FIG. 5. The rib 142 edge 144 engages and crushes the filament somewhat to lock the filament end 18 to the housing. The two segments are heat welded together at the annular side wall edges of male segment In FIG. 30, a padlock type seal 154 has a preferably transparent housing 158. Filament 156 is preferably a single strand solid metal wire. The housing 158 is an elongated solid rectangle molded thermoplastic material with two parallel elongated circular cylindrical chambers 160, 162. The chambers preferably are the same diameter. Chamber 160 may be optionally blocked and enclosed at one end by solid plug 164 heat welded, bonded or press fit to the surrounding housing material. In FIG. 31, the housing is formed with an annular recess 166 and 168 respectively in chambers 160 and 162 approximately medially the chamber. The recesses 166 and 168 are relatively shallow. An insert 170 is in each recess 166 and 168. The insert 170 comprises a finger tip support washer and a locking element of one of the embodiments as described above in connection with FIGS. 4, 8–10, 13, 14–17 and 22–29, and preferably the embodiment of FIGS. 4 or 8–10. The locking element 172 of the insert faces the plug 164 and the washer 174 faces in the opposite direction.

A second plug 176 and 178 is at the ingress region of the respective chambers 160 and 162. The plugs 176 and 178 are recessed below the upper surface 180 of the housing 158. The plugs 176 and 178 are each connected to the housing 158 by a thin annular web forming a weak section. The plugs 176 and 178 have respective through bores 184.

In operation, the filament 156 end 186 is inserted into chamber 160 through the plug 176 bore 184, FIG. 30. The insert 170 is in the recess 166 and retained axially in this recess. The filament end 186 is passed through the washer aperture and then through the locking element displacing the fingers and tips as shown in FIGS. 5 or 17, for example. This results in the configuration of FIG. 30 wherein the free end 188 may be passed through an article to be secured by the seal 154.

The free end 188 is then passed into the chamber 162 and engaged with the insert 170' in the chamber 162. Both ends of the filament are now locked to a locking element of the corresponding insert. In case of tampering, the filament would be withdrawn in direction 190. The locked inserts 170 and 170' grip the filament 156 and the withdrawal force displaces the inserts 170 and 170' out of the respective recesses 166 and 168 as shown in FIG. 31. The displacement of the inserts from the recesses indicates tampering.

If sufficient withdrawal force is exerted on the filament 156, then one or both of the plugs 176 and 178 will fracture at the weak webs 182. The inserts force the plugs to sever from the housing 154 making the seal inoperative. The separated plugs provide evidence of tampering. A further plug such as plug 164 may also be welded or fastened to the housing in chamber 162. This further plug blocks the chamber 162 bottom region distal the plug 178. This latter plug precludes tampering with the insert 170' in the chamber 162.

In FIGS. 33–36, a further embodiment of a padlock seal 192 includes two mating housing segments 194 and 196 made of molded thermoplastic material. Segments 194 and 196 are substantially mirror image structures and thus only segment 196 will be described. Housing segment 196 comprises a solid rectangular body 198 with a flange 200 at one end. A central cavity 202 is provided to minimize the amount of material employed. Two projections 204 mate with corresponding recesses in the segment 194 to align and secure the segments together which segments are also heat welded together to form a unitary structure.

A filament receiving linear arranged channel structure 206 is formed in the surface 209 of segment 196 adjacent to segment edge 210. A second filament receiving channel structure 208 is formed adjacent to edge 212 and is a mirror image of structure 206. Structure 206 includes a semi-circular cylindrical projection 214 and a semi-circular cylindrical recess 216 aligned in an axial direction. The projection 214 and recess 216 have an axial extent of about the same value.

A semi-circular cylindrical recess 218 is intermediate the projection 214 and recess 216 and axially aligned therewith. A plurality of like radii axially aligned semi-circular cylindrical channels 220 are formed in the surface 209 aligned centrally of and with the projection 214 and recesses 216 and 218. A bore 222 of the same transverse radial dimension as channels 220 is in projection 214. The channels 220 and bore 222 receive linear end 224 of solid wire, stranded wire or plastic filament 226.

An insert 228 comprising a washer 230 and a locking element 232 are in abutting juxtaposed relation in recess 218 which holds the insert components in close abutting relation. The central aperture of the washer 230 and the abutting tips of the element 232 (the washer and element being described above in connection with the various embodiments of inserts) are aligned with the channels 220 and bore 222.

The channel structure 208 is a mirror image of structure 206 except that projection 234 is in a location that corresponds to that of the recession 206 and the recess 236 is in a location that corresponds to the projection 214. Channels 220' and the bore in the projection 234 receive the end 238 of the filament 226. The recess 218' receives the insert 228'. The components with primed reference numerals are identical to the components with same reference numerals but without the prime.

The housing segment 194 has identical structure as described above for segment 196 with aligned mating recesses which receive the projections 214 and 234 and inserts 228 and 228'. The surface 240 of the segment 194 thus is identical to that of segment 196 surface 209 except for projections 204. The body 198 has a hollow region 242, FIG. 35, to permit molding the bore 222.

There thus has been shown and described a seal comprising a filament; a housing defining a first chamber with a first opening having a transverse dimension, the filament for being received in and passing through the opening into the chamber; and a spring metal filament first locking insert captured in the chamber, the insert having a plurality of radially inwardly extending resilient fingers each of a transverse width and terminating at a tip, at least one of the tips tapering to substantially a point, the tips defining a region therebetween smaller than the filament thickness, the filament for being received in the region in a first insertion direction through the opening, the filament for abutting and flexing the tips such that the tips impose a resilient compressive load against the inserted filament, the filament and insert being of relative hardness such that the at least one tip point digs into the received inserted filament in response to withdrawal of the filament from the chamber in a second direction opposite the first insertion direction to sever the filament as the filament is withdrawn.

The chamber and the insert as described include means cooperatively arranged so that the insert rotates in response to rotation of the received filament.

As also shown and described, the insert comprises an annular array of fingers, a plurality of the fingers of the array each having a tip tapering substantially to a point.

It will occur to one of ordinary skill that various modifications may be made to the disclosed embodiments. The disclosed embodiments are given by way of illustration and not limitation. It is intended that the scope of the invention is as defined in the appended claims.

What is claimed is:

1. A seal comprising:

a filament;

a housing defining a first chamber with a first opening having a transverse dimension, the filament for being received in and passing through the opening into the chamber; and a spring metal filament first locking insert captured in the chamber, the insert having a plurality of radially inwardly extending resilient fingers each of a transverse width and terminating at a tip, at least one of the tips tapering to substantially a point, the tips defining a region therebetween smaller than the filament thickness, the filament for being received in the region in a first insertion direction through the opening, the filament for abutting and flexing the tips such that the tips impose a resilient compressive load against the inserted filament, the filament and insert being of relative hardness and dimensions such that the at least one tip point digs into the received inserted filament in response to withdrawal of the filament from the chamber in a second withdrawal direction opposite the first insertion direction and such that the filament is severed as the filament is withdrawn.

2. The seal of claim 1 wherein the chamber and the insert are arranged so that the insert rotates in response to rotation of the inserted received filament at least in response to a force on the insert by the inserted filament in the second withdrawal direction.

3. The seal of claim 1 wherein the insert comprises an annular array of said fingers, a plurality of the fingers of the array each having a tip tapering substantially to a point.

4. The seal of claim 1 wherein the insert includes at least two fingers having nested complementary tips.

5. The seal of claim 1 wherein the insert is a circular element and includes an annular array of identical fingers each with a tip tapering to said point.

6. The seal of claim 5 wherein all said tips abut each other in a plane.

7. The seal of claim 5 wherein the filament has a transverse thickness and the tips are in close but spaced relationship, which spaced relationship defines a transverse space smaller than said filament thickness.

8. The seal of claim 5 wherein the insert is a circular cylindrical disk and all of said tips mate at the center of said disk in complementary symmetrical pointed fashion.

9. The seal of claim 1 wherein the insert has a flat periphery lying in a plane with the fingers biased out of the plane and having a given thickness, the fingers each being defined by a radial dimension and a dimension transverse the radial direction which transverse dimension is substantially larger than said given thickness.

10. The seal of claim 1 wherein the housing opening has a transverse dimension, further including a support member in the chamber between the housing opening and the insert, said support member having an aperture for receiving said filament therethrough, the aperture having a transverse dimension smaller than the transverse dimension of said housing opening, said support member for precluding bending of the fingers in said second direction in response of a force applied to the received filament in the second direction.

11. The seal of claim 10 wherein the insert is a hardened spring steel flat disk and the support member is a hardened spring flat steel disk.

12. The seal of claim 10 wherein the support member is hinged to the insert by a flexible connecting element.

13. The seal of claim 1 wherein the housing comprises a first housing member having a circular cylindrical cavity and a second circular cylindrical housing member having said chamber, the second housing member being received in said cavity, and means for securing the first housing member to the second housing member.

14. The seal of claim 13 further including a connecting element for hinging the first housing member to the second housing member, the housing being one piece molded thermoplastic.

15. The seal of claim 1 including a support member between the housing and insert in said chamber for supporting the finger tips in the presence of a force applied to the inserted received filament in the second direction.

16. The seal of claim 15 wherein the insert and support member are steel circular disks and the chamber is circular cylindrical, the opening being larger in transverse dimension than said filament, the support member having a second opening smaller in diameter than said housing first opening.

17. The seal of claim 1 wherein the housing includes two complementary housing portions, a first portion having a cavity and a second portion having a male projection located in the cavity, an end of the filament being located in the cavity between the first and second portions, the housing including a rib member in the cavity for locking the filament end to the housing.

18. The seal of claim 1 wherein the filament has first and second end portions, the first end portion being secured to the first insert in the first chamber, the housing having a second chamber and a second opening in communication with the second chamber, further including a second insert identical to the first insert in the second chamber for receiving the second end for selectively locking the second end to the housing.

19. The seal of claim 18 wherein each said insert is a hardened steel circular disk, each said chamber being circular cylindrical and elongated defining a longitudinal axis, each chamber having an annular recess for receiving the corresponding insert, said recess for releasably retaining the corresponding insert axially in the respective chamber.

20. The seal of claim 18 wherein each said insert comprises a circular disk, each said chamber being circular cylindrical, further including a support member adjacent to and corresponding to each insert for supporting the finger tips, the support member being located between the corresponding insert and opening to resist bending of the fingers in the withdrawal second direction in response to a withdrawal force on the filament.

21. The seal of claim 18 wherein the housing comprises a body including first and second portions, the first opening being in the first portion and the second opening being in the second portion, the body including a third portion having said chambers, said first and second portions being coupled to the third portion by weakening means such that the first and second portions will selectively independently sever from the third portion in response to a withdrawal force on the corresponding insert by the filament prior to severance of the filament.

22. The seal of claim 1 wherein the at least one finger has a width and a length forming a rectangular member, the tip being at a radially inward end of the length, the width tapering transversely to said point.

23. The seal of claim 22 wherein the insert and fingers lie in a plane, the transverse width of said fingers and the thickness thereof being sufficiently great to preclude lateral circumferential twisting of the fingers in said plane in response to rotation of the inserted filament secured thereto.

24. In a seal having a housing and a filament locking insert captured in the housing for locking the filament thereto, the filament passing through the insert and housing, the insert comprising:

a circular cylindrical disk having a plurality of rectangular radially inwardly extending fingers each finger terminating at a tapered pointed tip, the tips abutting and complementary;

a tip support member having a central aperture aligned with said complementary pointed tips for receiving a filament therethrough, the support member for supporting the tips to preclude bending of the tips in a first direction normal to the plane of the disk and for permitting the tips to flex in a second direction opposite the first direction; and means for securing the support member adjacent to the disk.

25. The seal of claim 24 wherein a first portion of the fingers have a first length and a second portion of the tips have a second length different than the first length.

* * * * *